United States Patent [19]

Kago et al.

[11] Patent Number: 4,581,685

[45] Date of Patent: Apr. 8, 1986

[54] ULTRASONIC TRANSDUCER

[75] Inventors: Yoshiyuki Kago, Nukata; Shigeyuki Akita, Okazaki, both of Japan

[73] Assignee: Nippon Soken, Inc., Nishio, Japan

[21] Appl. No.: 519,665

[22] Filed: Aug. 2, 1983

[30] Foreign Application Priority Data

Aug. 3, 1982 [JP] Japan ..... 57-136120

[51] Int. Cl.[4] ..... H04R 00/00

[52] U.S. Cl. ..... 367/140; 367/173

[58] Field of Search ..... 367/140, 151, 165, 173; 362/80; 350/307; 343/7 VM; 310/349, 335

[56] References Cited

U.S. PATENT DOCUMENTS 1,827,955 10/1931 Rodriguez .
2,459,162 1/1949 Hayes .
3,028,752 4/1962 Bacon .
3,046,644 7/1962 Auer, Jr. et al. .
3,109,155 10/1963 Degen .
4,104,610 8/1978 Inoue et al. .
4,348,750 9/1982 Schwind ..... 367/140
4,433,398 2/1984 Kodera et al. ..... 367/140

*Primary Examiner*—Theodore M. Blum
*Assistant Examiner*—David Cain
*Attorney, Agent, or Firm*—Cushman, Darby & Cushman

[57] ABSTRACT

An ultrasonic transducer having an ultrasonic vibrator for transmitting and receiving ultrasonic waves, and a reflecting plate for imparting directivity to the ultrasonic waves transmitted by the ultrasonic vibrator and for converging the received ultrasonic waves. In the reflecting plate, at least one through hole is formed for passing snow and mud blown upon the reflecting plate by the wind. Each through hole is configured so as not to deteriorate substantially the reflective capacity of the plate.

9 Claims, 9 Drawing Figures

ULTRASONIC TRANSDUCER

BACKGROUND OF THE INVENTION

The present invention relates to an ultrasonic transducer which is mounted on a vehicle for detecting an obstacle near the vehicle or communicating with other vehicles.

The ultrasonic transducer of this type comprises an ultrasonic vibrator for transmitting and receiving ultrasonic waves, and a reflecting plate for imparting directivity to the ultrasonic waves transmitted by the ultrasonic vibrator and converging the received ultrasonic waves. The ultrasonic transducer having such a construction as described above is generally mounted to a front bumper or rear bumper of a vehicle so that the reflecting plate faces the travelling direction of vehicle.

Therefore, snow and mud carried with wind is liable to adhere to the reflecting plate so that the function of the ultrasonic transducer is remarkably reduced.

SUMMARY OF THE INVENTION

The ultrasonic transducer of the present invention is provided with an ultrasonic vibrator and a reflecting plate which is disposed in the rear of the ultrasonic vibrator. In the reflecting plate, at least one through hole is formed in the reflecting plate for discharging snow and mud blown upon the reflecting plate by the wind. By selecting the position and size of the through hole and the distance between adjacent through holes, snow and mud can be discharged out of the through hole without reducing the ultrasonic wave reflecting ratio of the reflecting plate.

One object of the present invention is to provide an ultrasonic transducer suitable to be used at a position to which snow and mud is liable to adhere.

Another object of the present invention is to provide an ultrasonic transducer comprising a reflecting plate having excellent reflecting capacity, but from which snow and mud blown with wind is prevented from adhering thereto.

DESCRIPTION OF THE DRAWINGS

FIG. 3 is a front view of the first embodiment;

FIG. 4 is a sectional view taken along the line IV—IV of FIG. 3;

FIG. 5 is a sectional view taken along the line V—V of FIG. 3;

FIG. 6 is a view showing the relation among the slit width, the slit distance and the gain loss;

FIG. 8 is a front view of the third embodiment; and

FIG. 9 is a sectional view taken along the line IX—IX of FIG. 8.

DETAILED DESCRIPTION OF THE EMBODIMENTS

Hereinafter, the present invention will be explained in accordance with embodiments thereof with reference to the accompanying drawings.

Figure 1:
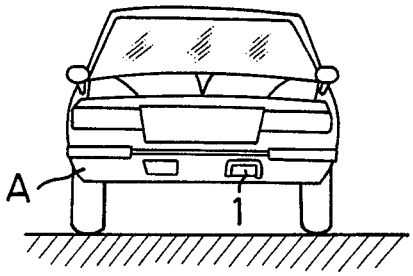
FIG. 1 is a view showing the ultrasonic transducer of the present invention mounted to a front bumper of a vehicle.
Figure 2:
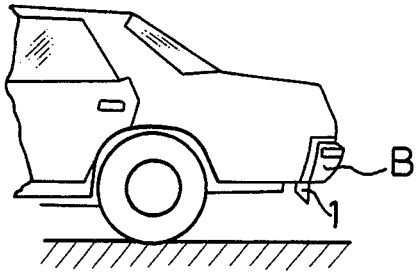
FIG. 2 is a view showing the ultrasonic transducer of the present invention mounted to a lower portion of a rear bumper of a vehicle.

As shown in FIGS. 1 and 2, the ultrasonic transducer 1 of the present invention is mounted to a front bumper A or the lower portion of a rear bumper B of a vehicle.

Figure 3:
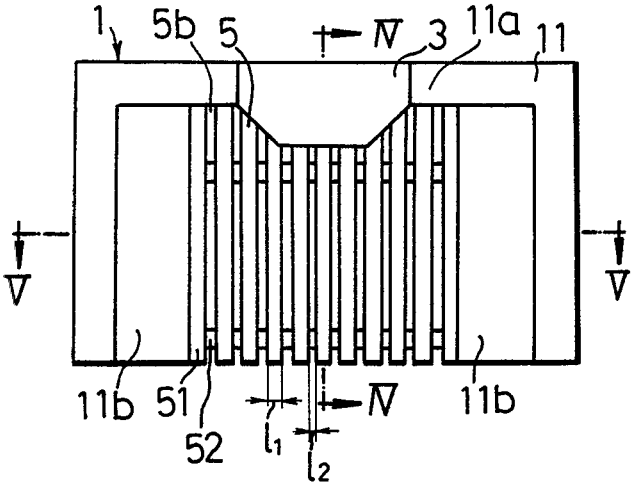
FIGS. 3 to 6 illustrate a first embodiment of the ultrasonic transducer according to the present invention.
Figure 4:
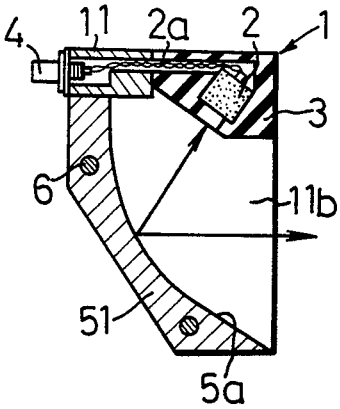
Figure 5:
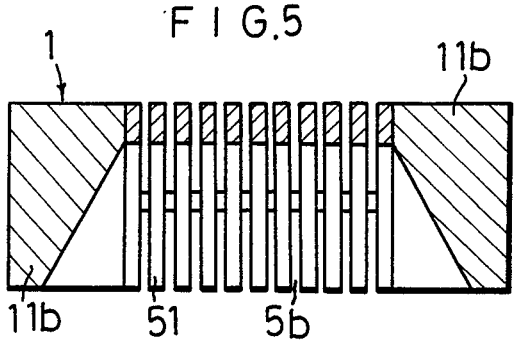

FIGS. 3 to 5 illustrate a first embodiment of the present invention.

A housing 11 of the ultrasonic transducer 1 is made of synthetic resin or metal. Into the central portion of a top wall 11*a*, a casing 3 made of rubber is closely inserted. An ultrasonic vibrator 2 is accommodated within the front portion of the casing 3 so as to obliquely face rearwards. The electric signal generated by the ultrasonic vibrator 2 is fed out of the ultrasonic transducer 1 by way of a lead wire 2*a* through a connector 4 provided on the rear end surface of the casing 3.

The opposed inner surfaces of side walls 11*b* of the housing 11 incline and the thickness of the side walls 11*b* increases rearwards. Between the rear end portions of the side walls 11*b*, a reflecting plate 5 provided with a plurality of parallel slits 5*b* which are arranged at predetermined distances, is provided.

In this embodiment, the reflecting plate 5 is formed by arranging a plurality of strip-shaped plates 51, each of which has a width of $l_1$, in parallel with one another so as to be spaced from one another by a predetermined distance (slit width) of $l_2$, and connecting the plates 51 by means of round rods 6 which extend between the opposed side walls 11*b*.

The slit width $l_2$ between adjacent strip-shaped plates 51 is maintained by means of collars 52 which are installed around the round rods 6.

The reflecting plate 5 is made of the same synthetic resin or metal as the housing 11.

The front surface of the reflecting plate 5, namely the reflecting surface 5*a*, is formed into a concave paraboloidal surface and the ultrasonic vibrator 2 faces towards the paraboloidal surface and is positioned at a focus thereof.

In operation, when an electric signal is supplied to the ultrasonic vibrator 2 of the ultrasonic transducer 1 having the above described structure, by way of the lead wire 2*a* through the connector 4, the ultrasonic vibrator 2 generates ultrasonic waves. The ultrasonic waves from the ultrasonic vibrator 2 are reflected on the reflecting surface 5*a* of the reflecting plate 5 and directed in the horizontal direction as shown by an arrow in FIG. 4.

The ultrasonic wave entering toward the reflecting plate 5 in the horizontal direction is reflected on the reflecting surface 5*a* and converged on the ultrasonic vibrator 2. The converged ultrasonic wave is converted into an electric signal and is fed out of the transducer 1 by way of the lead wire 2*a* through the connector 4.

According to the ultrasonic transducer of this embodiment, when wind containing snow or mud is blown against the reflecting plate 5, the wind flows through the slits 5*b* formed in the reflecting plate 5. Therefore, most of snow and mud passes through the slits 5*b* with the wind so that the adhesion of snow and mud to the reflecting surface 5*a* is remarkably reduced to prevent the function of the reflecting plate 5 from worsening.

In particular, fine particles of snow and rain almost pass through the slits 5*b* with the wind.

Figure 6:
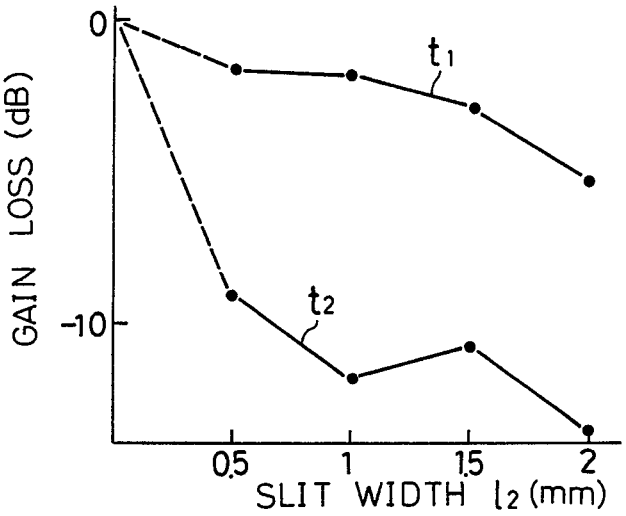

FIG. 6 shows experimental results in the relation among the slit width $l_2$, the slit distance (plate width) $l_1$ and the reflecting capacity ( gain loss ). The line $t_1$ shows the case when the slit distance $l_1$ is 5 mm while the line $t_2$ shows the case when the slit distance $l_1$ is 1 mm. And the paraboloidal shape of the reflecting surface 5*a* of the reflecting plate 5 is expressed by the equation: $y=120 \times x^2$.

As is apparent from FIG. 6, when the slit distance $l_1$ is 5 mm (line $t_1$), as the slit width $l_2$ increases, the reflecting capacity is reduced but the reduction ratio is very small.

If the allowed gain loss is 2 dB, the slit width $l_2$ can be made as wide as 1.2 mm.

In contrast, when the slit distance $l_1$ is 1 mm (line $t_2$), as the slit width $l_2$ increases, the gain loss remarkably increases.

When the slit width $l_2$ is too small, snow and mud cannot pass through the slits. Therefore, the slit width $l_2$ of not less than 0.5 mm is required.

Thus, the reflecting plate having a slit distance $l_1$ of 1 mm and a slit width $l_2$ of not less than 0.5 mm, exhibits low reflecting efficiency so as not to be practically used.

In order to maintain the gain loss at not more than 2 dB and prevent snow and mud from adhering to the reflecting plate, it is preferable to set the slit width $l_2$ to $0.5 \sim 1.5$ mm and the slit distance $l_1$ to $4 \sim 6$ mm.

If a large value of slit width $l_2$ is selected, it is preferable to select a large value for slit distance $l_1$.

When the slit distance $l_1$ exceeds 6 mm, adhesion of snow and mud increases, even if the slit width $l_2$ is made large.

As described above, according to the present invention, by forming a large number of slits in the reflecting plate of the ultrasonic transducer so as not to reduce the reflecting function thereof, the wind passes through the slits to prevent snow and mud from adhering to the reflecting plate.

Figure 7:
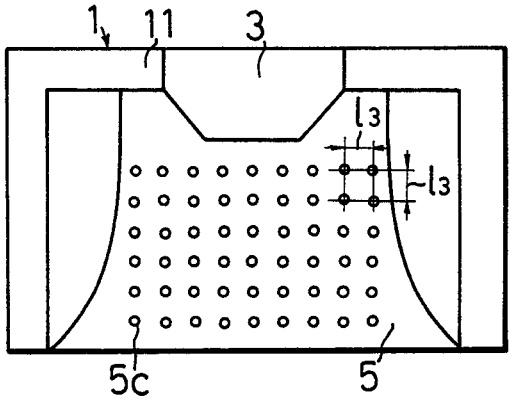
FIG. 7 is a front view of a second embodiment.

FIG. 7 illustrates a second embodiment of the ultrasonic transducer according to the present invention. In the reflecting plate 5, a large number of circular small holes 5*c* are formed at predetermined distances $l_3$.

In order to maintain the gain loss at the level nearly equal to that of the first embodiment, and to prevent the adhesion of snow and mud, it is preferable to set the diameter of the small holes to $3 \sim 6$ mm and set the distance $l_3$ of the small holes to $10 \sim 15$ mm.

Figure 8:
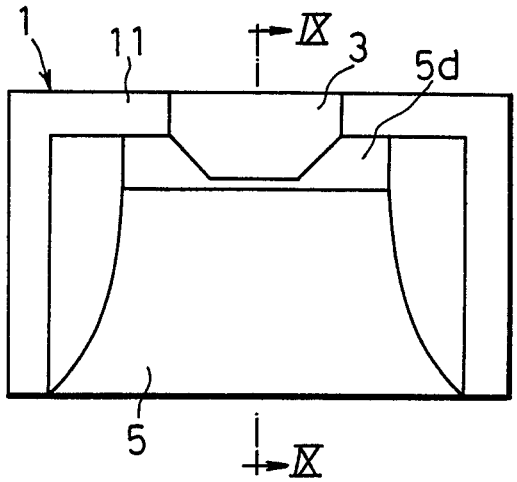
FIGS. 8 and 9 illustrate a third embodiment of the ultrasonic transducer according to the present invention.
Figure 9:
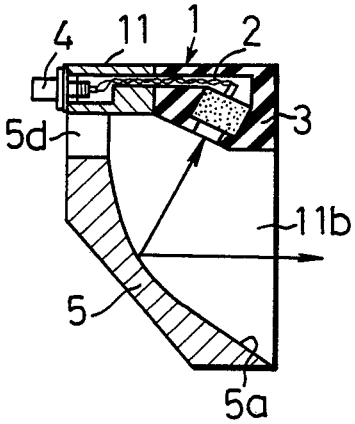

FIGS. 8 and 9 illustrate a third embodiment of the present invention. In this embodiment, a through hole is formed in such a region of the reflecting plate as not to reflect ultrasonic wave to be received by the ultrasonic vibrator 2.

Namely, in FIG. 9, only the ultrasonic waves entering in the horizontal direction from the right reach the vibrator 2. The ultrasonic waves reflected on the upper portion of the reflecting plate 5 do not reach the ultrasonic vibrator 2. In this embodiment, in the upper portion of the reflecting plate 5, a through hole 5*d* is formed. The wind blowing on the reflecting plate 5 rises along the reflecting surface 5*a* and then rapidly passes rearwards through the through hole 5*d*. Therefore, snow and mud carried by wind do not adhere to the reflecting surface 5*a*. In addition, since the through hole is formed in such a region as not to act as a reflecting plate, the ultrasonic wave converging capacity is not reduced. It is preferable to make the size of the through hole larger within such a region in order to improve the effect of preventing the adhesion of snow and mud.

As described above, according to the present invention, by making the wind mixed with snow or mud pass through the through hole formed in the reflecting plate of the ultrasonic transducer without staying in the reflecting plate, the adhesion of snow and mud to the reflecting plate can be prevented so that the ultrasonic transducer can be used under bad weather conditions.

What is claimed is:

1. An ultrasonic transducer comprising:

an ultrasonic vibrator for transmitting and receiving ultrasonic waves; and a reflecting plate having a reflecting surface for reflecting said ultrasonic waves, said reflecting plate being provided with at least one through hole for passing snow and mud blown against the reflecting plate, said at least one hole being so configured as to leave the reflective capacity of said plate substantially unaffected.

2. An ultrasonic transducer according to claim 1, wherein:

said at least one through hole is composed of a large number of slits formed in said reflecting plate.

3. An ultrasonic transducer according to claim 2, wherein:

said slits are formed in parallel with one another;

the width of each slit is not less than 0.5 mm and not more than 1.5 mm; and the distance between adjacent slits is not less than 4 mm and not more than 6 mm.

4. An ultrasonic transducer according to claim 1, wherein:

said at least one through hole is composed of a large number of disconnected small holes.

5. An ultrasonic transducer according to claim 4, wherein:

the diameter of said small holes is not less than 3 mm and not more than 6 mm; and the distance between the centers of adjacent small holes is not less than 10 mm and not more than 15 mm.

6. An ultrasonic transducer according to claim 1, wherein:

said at least one through hole is composed of one through hole which is formed in an upper region of said reflecting plate.

7. An ultrasonic transducer comprising:

an ultrasonic vibrator for transmitting and receiving ultrasonic waves; and a reflecting plate having a reflecting surface for reflecting said ultrasonic waves transmitted and received by said ultrasonic vibrator, said plate having a plurality of through holes for passing snow and mud blown against said reflecting plate, said holes being so configured as to leave the reflective capacity of said plate substantially unaffected.

8. An ultrasonic transducer according to claim 7 wherein said plurality of through holes include a plurality of parallel slits, each slit having a width greater or equal to 0.5 mm and less than or equal to 1.5 mm, a distance between adjacent slits being greater than or equal to 4 mm and less than or equal to 6 mm.

9. An ultrasonic transducer according to claim 7 wherein said plurality of through holes include a plurality of substantially circular holes wherein each said hole has a diameter greater than or equal to 3 mm and less than or equal to 6 mm, a distance between centers of adjacent holes being greater than or equal to 10 mm and less than or equal to 15 mm.

* * * * *